US007461460B2

(12) United States Patent
Priebe

(10) Patent No.: US 7,461,460 B2
(45) Date of Patent: Dec. 9, 2008

(54) SIGHTING SYSTEM

(76) Inventor: Donald Priebe, P.O. Box 482, Pinckney, MI (US) 48169

( * ) Notice: Subject to any disclaimer, the term of this patent is extended or adjusted under 35 U.S.C. 154(b) by 45 days.

(21) Appl. No.: 11/619,875

(22) Filed: Jan. 4, 2007

(65) Prior Publication Data

US 2008/0163503 A1 Jul. 10, 2008

(51) Int. Cl.
*F41G 1/467* (2006.01)

(52) U.S. Cl. ..... 33/265; 124/87

(58) Field of Classification Search ..... 33/265; 124/87

See application file for complete search history.

(56) References Cited

U.S. PATENT DOCUMENTS 3,997,974 A 12/1976 Larson
4,602,437 A 7/1986 Berthiaume
5,025,565 A * 6/1991 Stenerson et al. ..... 33/265
5,367,780 A * 11/1994 Savage ..... 124/87
5,671,724 A * 9/1997 Priebe ..... 124/87
5,784,182 A * 7/1998 Francoeur et al. ..... 33/265
5,802,726 A * 9/1998 Trosper et al. ..... 33/265
2003/0177651 A1 9/2003 Stone

* cited by examiner

*Primary Examiner*—G. Bradley Bennett
(74) *Attorney, Agent, or Firm*—Brinks Hofer Gilson & Lione

(57) ABSTRACT

A sighting system for a shooting device, such as an archery bow or a firearm, includes front and rear sights. The front sight includes a front sight frame that defines a front sight window therein. A rear sight includes a rear sight frame that defines a rear sight window therein. A rear face of the front sight frame, the face oriented toward the rear sight, includes an indicium, such as a luminous ring, formed thereon. The rear sight frame is of a size such that the luminous ring is at least partially obstructed in a first manner by the rear sight frame when the shooting device is properly aimed at a target and is at least partially obstructed in a second manner when improperly aimed.

20 Claims, 3 Drawing Sheets

SIGHTING SYSTEM

BACKGROUND

1. Field of the Invention

The present invention relates to a sighting system for weapons such as archery bows and firearms, used in hunting or target shooting. More specifically, this invention is concerned with a sighting system that assists in eliminating weapon torque during the aiming/alignment process.

2. Description of Related Technology

It has long been recognized that weapons, such as archery bows and firearms, are difficult to shoot with consistent accuracy without the aid of optics, such as scopes. Many factors can contribute to the inaccuracy of a shot. Such factors include, without limitation the distance to the target, the size of the target, the speed of the projectile, the weight of the projectile, the wind and visibility conditions, as well as the attitude and torque of the weapon itself. Since the distance to the target and the projectile speed both effect the amount of drop the projectile will experience, some consider the attitude or vertical orientation of the weapon to be the most significant factor influencing accuracy.

In comparison to other projectiles, an arrow projected from a bow exhibits a relatively low speed, approximately 175 to 300 feet per second. While compound bows and overdraw systems have increased the speed of the arrow and therefore lessened the amount of vertical drop, the affects of gravity still must be taken into account regardless of the length of the shot. This is typically done by changing the attitude of the bow and "holding above" the target when aiming the bow.

While instinct shooters rely on experience and familiarity with their equipment to compensate for accuracy influencing factors, most archers prefer to use a bow sight mounted to the riser of the bow. The typical bow sight is mounted to the riser so as to locate one or more sight pins forward of the riser, with the ends of the pins located on the same side as the arrow rest. Thus, the sight pins are generally positioned above the rest. The sight pins are vertically spaced from one another and are individually set by the archer, through trial and error, so that each pin corresponds with a predetermined shooting distance to the target. For example, one sight pin may be set for a fifteen yard shot, a second for a twenty-five yard shot and a third pin for a thirty-five yard shot. When set in this manner, the sight pin corresponding with the distance to the target is then aligned with the target during the shot.

One draw back of the above mentioned type of sight is that the pins only provide a single sighting point for the aiming of the bow. This therefore requires that the bow be held in the same position, relative to the archer for the sight to be accurate. If the bow is held slightly higher or lower relative to the archer, then inaccuracy will be introduced into the sighting process. As a result, a variety of "secondary sights", have been developed. Secondary sights typically provide the archer with a secondary aiming reference. This secondary aiming reference is used in conjunction with the previously mentioned front sight and therefore allows the bow to be more consistently held in the same position relative to the archer.

Perhaps the most common secondary sight is a "peep sight" mounted to the bow string. During use, once the bow string is drawn to full draw, the archer looks through the peep sight and then aligns the appropriate sight pin on the target. By forcing the archer to look through the peep sight, the bow is held at a more consistent position relative to the archer. While a peep sight system may be considered better than a mere front sight, these systems also have their disadvantages and drawbacks. One significant drawback is that the small aperture of the peep sight significantly limits the amount of light available for viewing the sight pin and the target. This diminished visibility is compounded by the fact that often, the best hunting times occur during the marginal light conditions of dawn and dusk.

Another type of secondary sight is a rear sight to be used in combination with the front sight. One such rear sight is disclosed in the present inventor's own U.S. Pat. No. 5,671,724, which is herein incorporated by reference. This patent discloses a rear sight ring that is positioned rearward of the riser, between the riser and the bow string itself. In aligning a bow equipped with such a sight, the sighting elements of the rear sight are always centered on the same pin of the front sight, for example the thirty-five yard pin. This properly orients the bow. While maintaining this alignment between the rear sighting elements and the particular front pin, the appropriate distance pin is then located on the target.

Torque or horizontal orientation is also a significant, but often overlooked, factor influencing accuracy in shooting a weapon. If the weapon is not consistently held in the same horizontal orientation, the projectile will be directed left or right of the target. With an archery bow for example, the riser and bow string are independent elements from one another. It is therefore possible to hold the riser and the bow string differently, relative to one another, during subsequent shoots. For example, when the riser is held in the archer's hand, if the riser is rotated about a vertical axis about the archer's hand (i.e. through the grip of the riser), then a sight located in the front of the riser will move in one direction, while a fixed point to the rear of the riser will rotate in the opposite direction. Thus, at full draw the bow string can be held in a consistent position relative to the archer, but the riser may be rotated via the archer's hand about a vertical axis. When held in this manner, it is still possible to align the peep sight with the front sight in the presence of this torque, and the arrow will be projected off line from the target, toward the right or the right depending on which directed the riser is rotated. Since the riser and bow string are independent of each other, the archery bow may be improperly aimed with a peep sight in this instance.

In view of the above limitations and drawbacks, it is seen that there exists a need for an improved sight that can be used to more accurately aim a weapon at the target, without overly complicating the shooting process and without compromising the vision of the shooter during lowlight situations.

In overcoming the drawbacks and limitations of the know technology, it is an object of the present invention to provide a sight that can aid a shooter in shooting consistency and accuracy with a weapon, such as a firearm, archery bow or other weapon.

Thus, in one aspect the present invention provides a sighting apparatus that allows the shooter to aim the weapon with a consistent attitude. In another aspect, the present invention provides a sighting apparatus that allows the shooter with neutral torque.

In yet another aspect, the present invention provides sighting apparatus that lends itself to use during lowlight conditions.

SUMMARY

In satisfying the above need, as well as overcoming the enumerated drawbacks and other limitations of the related art, the present invention provides a sighting system for a weapon that includes dual sights, a front sight and a rear sight. When properly aligned and the weapon is not experiencing torque, the rear sight obstructs an indicium provided on the front sight. If the weapon is being subjected to torque, then the indicium on the front sight will be visible to the shooter and correction in aiming can be made.

The front and rear sights are supported on a mount that configured so as to be mounted to an archery bow, a firearm or other weapon. While the front sight is supported toward a distal end of the mount, the rear sight is supported toward the opposing or proximal end of the mount.

The front sight also includes a front sight frame or ring that defines a front sighting area. Within the front sighting area, at least one sight pin extends generally from the front sight ring toward a center area of the front sighting area. The front sight ring also includes a face oriented toward the proximal end of the mount. At least a portion of this face has an indicium provided thereon, which is visibly different from the remainder if the front sight ring.

The rear sight includes a rear sight ring or frame and, similarly to the front ring, defines a rear sighting area therein. When a shooter utilizes the sighting system of the present invention, the sight pin of the front sight is viewable through the rear sighting area. The rear sight ring is also of a size such that the indicium on the face of the front sight ring is obstructed by the rear sight ring when the weapon is properly aligned at a target and not being subjected to torque or other misalignment issue.

In another aspect, the indicium of the sighting system is formed of a photoluminescent material, preferably either a phosphorescent or florescent material. In a further aspect, the indicium of the sighting system may be formed of a fiber optic material.

In yet another aspect of the invention, the front and rear sight rings of the sighting system are of the same general shape, preferably having at least a portion that is ring-like. In still another aspect of the invention, the sighting areas defined front and rear sight ring generally annular.

In another aspect, the sighting system of the invention is provides front and rear sight rings that have outer diameters of the same size. The radial thicknesses of the sight rings may either be the same or one may be greater than the other.

In yet another aspect of the invention, the rear sight ring is optionally provided with at least one sighting element that generally defines an open area; the open area being generally in the center of the rear sight area.

Further aspect, objects, features and advantages of this invention will become readily apparent to persons skilled in the art after a review of the following description, with reference to the drawings and claims that are appended to and form a part of this specification.

DETAILED DESCRIPTION

Figure 1:
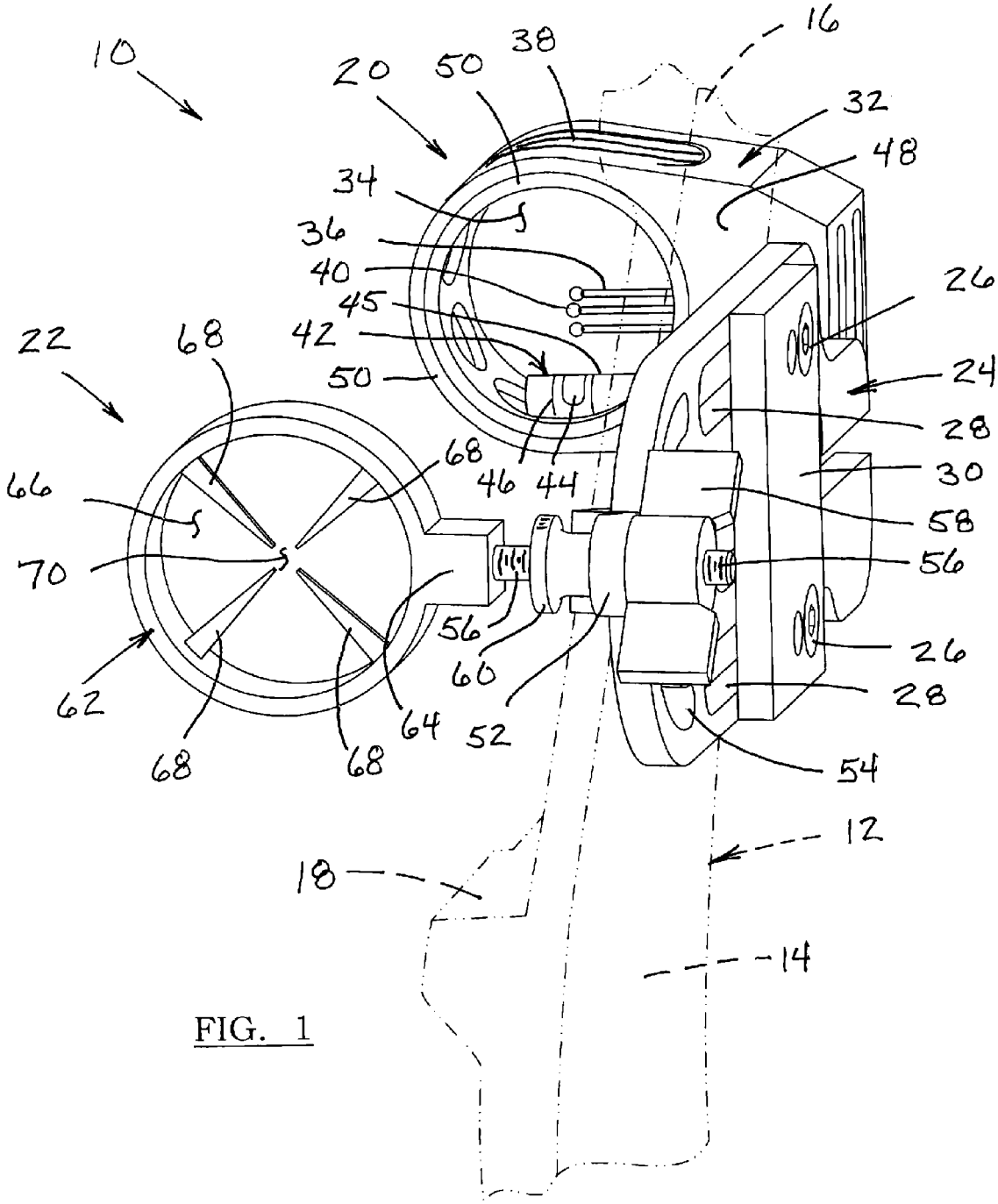
FIG. 1 is a rear perspective view of a sighting system, embodying the principles of the present invention, mounted to the riser of an archery bow.

Referring now to the drawings, a sighting system embodying the principles of the present invention is illustrated in FIG. 1 and generally designated at 10. While the sighting system 10 is illustrated as being mounted to the riser of an archery bow, it will be appreciated that the present invention is intended for use with other weapons or devices that require aiming. Such other weapons include, without limitation, firearms. However and for the sake of clarity and brevity, the following description will be limited to describing the sighting system 10 in connection with an archery bow. Unless specifically defined as such therein, the appended claims are not intended to be restricted to any particular type of weapon.

A typical bow 12 includes the riser 14 from which extend a pair of limbs (not shown). If the bow is a compound bow, one or both of the limbs 16 includes a wheel or pulley mounted at its end. A bow string (not shown), extending between the limbs 16 and around the pulley, is provided with nocks that allow for an arrow (not shown) to be squarely located on the bow string relative to an arrow rest 18 attached to or formed with the riser 14.

It is noted that the rearward and forward directions referred to in the following description are for reference purposes only and are to be determined relative to the shooting direction of the particular weapon to which the sighting system 10 is utilized. For example, in an archery bow application of the invention, the forward direction is the direction in which an arrow would be projected from the bow. The rearward direction would accordingly be toward the archer.

The illustrated bow 12 of the figures is a right handed bow. Obviously, the present invention could be utilized in a left hand configuration. In such a configuration, left and right designations in the description would merely be reversed.

When configured for mounting to an archery bow 12, a sighting system 10 embodying the principles of the present invention will typically be mounted to the riser 14 on a side opposite of the arrow rest 18. The sighting system 10 principally includes a front sight 20, a rear sight 22, and a mount 24 located therebetween. The mount 24, which may be in the form of a common mounting plate, is secured to the riser 14 by screws or other fasteners 26. To provide adjustability in the mounting of the sighting system 10, the mount 24 may be provided with one or more slots 28. The slots 28 thus enable the mount 24 to be variably positioned forward, rearward, upward and downward relative to the riser 14. A clamp bar 30 may be used in conjunction with the screws 26 so as to clamp the mount 24 between the clamping bar 30 and the riser 14.

As will become apparent from the following discussion, the front and rear sights 20, 22 may be formed as separate structures that are individually mounted and adjusted relative to the riser 14, each with its own mount 24. The mount 24 can be provided with additional features that will enable other shooting accessories to be mounted to it.

The front sight 20 is attached to a forward or distal end of the mount 24 such that the front sight 20 is located in a position forward of the riser 14. Generally, the front sight 20 mounts at an angle that is approximately 90° relative to the plane of the mount 24. As would be typical for a right handed bow 12, the front sight 20 extends from the mount 24 to the left. By being offset from the mount 24 in this manner, the front sight 20 is located to left of the riser 14 generally above the arrow rest 18. The front sight 20 may be attached to the mounting bracket 24 by any mechanism known in the industry, including without limitation, a threaded shaft and nut combination. Additionally, the front sight 20 may be axially adjustable and/or vertically adjustable relative to the mount 24. Since the various means for adjustable attaching a front sight to a mount 24 are well known in the industry, the specific details of such a mounting structure need not be discussed herein and are omitted in the interest of brevity.

The front sight 20 includes a front sight frame or ring 32. Generally centrally defined in the front ring 32 is an opening or aperture 34, which is hereinafter referred to as the "sight window 34". The front sight ring 32 may be formed of various materials and manufactured by various methods. Such materials include, without limitation, metals and plastics. Such manufacturing methods include, without limitation, machining, stamping and molding.

Multiple sight pins 36, three in the illustrated embodiment, extend from the ring 32 inwardly into the sight window 34. The sight pins 36 are mounted to the ring 32 as is well known in the industry, which may be an adjustable (which is preferred) or a fixed mounting. The sight pins 36 themselves may be formed from a variety of materials. One current practice is to construct the sight pins 36 from strands 38 of fiber optic material. In one possible construction, the strands 38 extend, in an exposed manner, about the periphery of the ring 32 before terminating in the sight pins 36 located within the sight window 34. The strands 38 are provided about the exterior of the frame 32 in an exposed manner to allow the strands 38 to collect light and thereby illuminate the tips 40 of the sight pins 36. Additional aspects and details of sight pins 36 as utilized in the art are well known and therefore need not be further described herein.

The front sight 20 may also be provided with a level 42, which is shown as being mounted to the sight ring 32 in a lowermost portion of the sight window 34. The level 42 is a common bubble-type level that includes an air bubble 44 retained within a liquid filled glass tube 45. When the level 42 is held in a horizontal position, the bubble 44 comes to rest between two spaced apart indicia or lines 46 provided on the glass tube 45. By using the level 42, the shooter can determine if the sighting system 10 is tilted out of horizontal, to either the left or the right.

An additional feature of the present invention is that a portion of the rearward face 48 of the sight ring 32 of the front sight 20 is luminesced. In particular, a luminous ring 50 is provided on the rear face 48 immediately adjacent to and, preferably completely circumscribed the sight window 34. While illustrated as completely circumscribing the sight window 34, it will be appreciated that the luminous ring 50 can be provided so as to be located about only a portion of the opening defining the sight window 34. In one embodiment, the luminous ring 50 is formed from a luminescent material. In this instance, the luminescent material may be any of the well known varieties of such materials. As such, the luminescent material may be a photoluminescent material, being either a phosphorescence or florescence type of material. Alternatively, the luminescent material may be an electroluminescent material, a chemoluminescent material (including bioluminescent materials) and others. In an alternative embodiment, the luminous ring 50 may be formed from a fiber optic material. In a further alternative embodiment, the luminous ring 50 may be a light pipe, a lighted ring, or a series or an array of light sources illuminated by any of the above means or via an electrical source, such as a battery or photovoltaic cell. Obviously, any other means which would provide for or illuminate the luminous ring 50 could alternatively be employed.

The rear sight 22 is mounted to the rearward or proximal end of the mount 24. The rear sight 22 may be mounted in a fixed position (as illustrated) via a single mounting boss 52 within an appropriately sized aperture defined in the boss 52. Alternatively, the rear sight 22 may be adjustably mounted in an arcuate or straight slot 54 provided in the rearward end of the mount 24. While various means can be used to mount the rear sight ring 22, one such means is illustrated and includes a threaded shaft 56 extended through the mounting boss 52 and engaged by a wing nut 58. A locking nut 60 is provided on the threaded shaft 56 such that the mounting boss 52 is clamped between the locking nut 60 and the wing nut 58. As one skilled in the art will appreciate, other mounting mechanisms could readily be used.

Relative to an archery bow 12, the rear sight 22 is positioned in a location between the riser 14 and the relaxed position of the bow string. Like the front sight 20, the rear sight 22 is positioned laterally away from the mount 24 and towards the same side of the riser 14 as the front sight 20. In the right-handed bow 12 of the figures, the rear sight 22 is located to the left of the riser 14, generally above the arrow rest 18.

The rear sight 22 includes a rear sight ring 62 attached to the inboard end of the threaded shaft 56. The ring 62 may be mounted by various means to the shaft 56 including being threadably engaged with the shaft, adhesively retained with the shaft, integrally molded onto the shaft or unitarily formed with the shaft. As shown, the ring 62 is unitarily formed with a boss 64 within which the shaft 56 is received.

Adjacent to the boss 64, the ring 62 is provided with an annular shape, within which an aperture or rear sight window 66 is defined. When aiming the sighting system 10, the sight pins 26 of the front sight 20 are viewed through this rear sight window 66. Optionally located within the rear sight window 66 are one or more sighting elements 68. The sighting elements 68 extend generally towards the center of the rear sight window 66 and, preferably, extend less than completely across the diameter of the rear sight window 66 so as to define an open area 70 generally in the center of the rear sight window 66. The sighting elements 68 may be provided in a variety of different forms and may be referred to by a variety of nomenclature. As such, the sighting elements 68 may be in the form of straight elements, tapered elements, line-like elements and may even terminated in a centered circular ring or other structure. Thus, the sighting elements may be referred to as sight elements, sight pins, crosshairs or a variety of other names. As illustrated, the sighting elements 68 are provided so as to diagonally extend into the sight window 66. As will be readily appreciated, these elements 68 could alternatively extend vertically or/and horizontally into the sight window 66.

In using an archery bow 12 with a properly set up and sighted-in sighting system 10 of the present invention, the archer raises the bow 12 and draws the bow string to full draw. In aiming such an equipped bow 12, the archer locates a predetermined one of the sight pins 36, such as the shortest distance sight pin or uppermost sight pin, so that the distal end or tip 40 of the sight pin 36 is generally centered within window 66 of the rear sight 22. If provided with the sighting elements 68, this centered area is may be easily found and determined. While maintaining the tip 40 of the predetermined sight pin 36 within the open area 70, the distance to the target is determined and the tip 40 of the appropriate distance sight pin 36, which may or may not be the same as the previously referred to sight pin 36, is located on the target. In doing this, the bubble 44 of the level 42 should be maintained between the level lines 46 to ensure that the bow 12 is not tilted toward the left or toward the right.

Since both the front and rear sights 20, 22 are mounted in fixed positions (forward and aft) relative to the rise, and are therefore not independent of the riser during the aiming process, the present system 10 enables a quick determination by the shooter as to whether or not torque (rotation of the bow about a vertical axis) has been introduced into the aiming process. In enabling this, the sighting system 10 of the present invention is provided with various structures, including the luminous ring 50.

In particular, at least a portion of the outer periphery of the front and rear sight rings 32, 62 are provided with the same general shape. As illustrated, the sight rings 32, 62 are round, but they could be provided with a rectangular or other shape. The sight rings 32, 62 are dimensioned such that, when the sighting system 10 is properly aligned without torque, the rear ring 62 occludes and prevent viewing of at least the luminous ring 50 of the front ring 32. In other words, the luminous ring 50 on the rear face 48 of the front sight ring 32, which is provided immediately about the sight window 34, is completely obscured by the ring 62 of the rear sight 22. Optionally, the entire front sight ring 32 may be occluded from view.

To achieve this, the rear ring 62 preferably has an outer dimension or diameter and a radial thickness that is about same as the outer dimension or diameter and radial thickness of the front ring 32. While preferably of about the same dimensions, these dimensions do not have to be the same. For example, the diameter or dimensions of the rear sight window 66 may be smaller than the diameter or dimensions of the front sight window 34. The particular application and the distance between the front and rear sights 20, 22, as well as the distance from the rear sight to the eye of the shooter, will dictate the required dimensions needed to achieve the obscuring of the luminous ring 50 by the rear sight ring 62.

Figure 2:
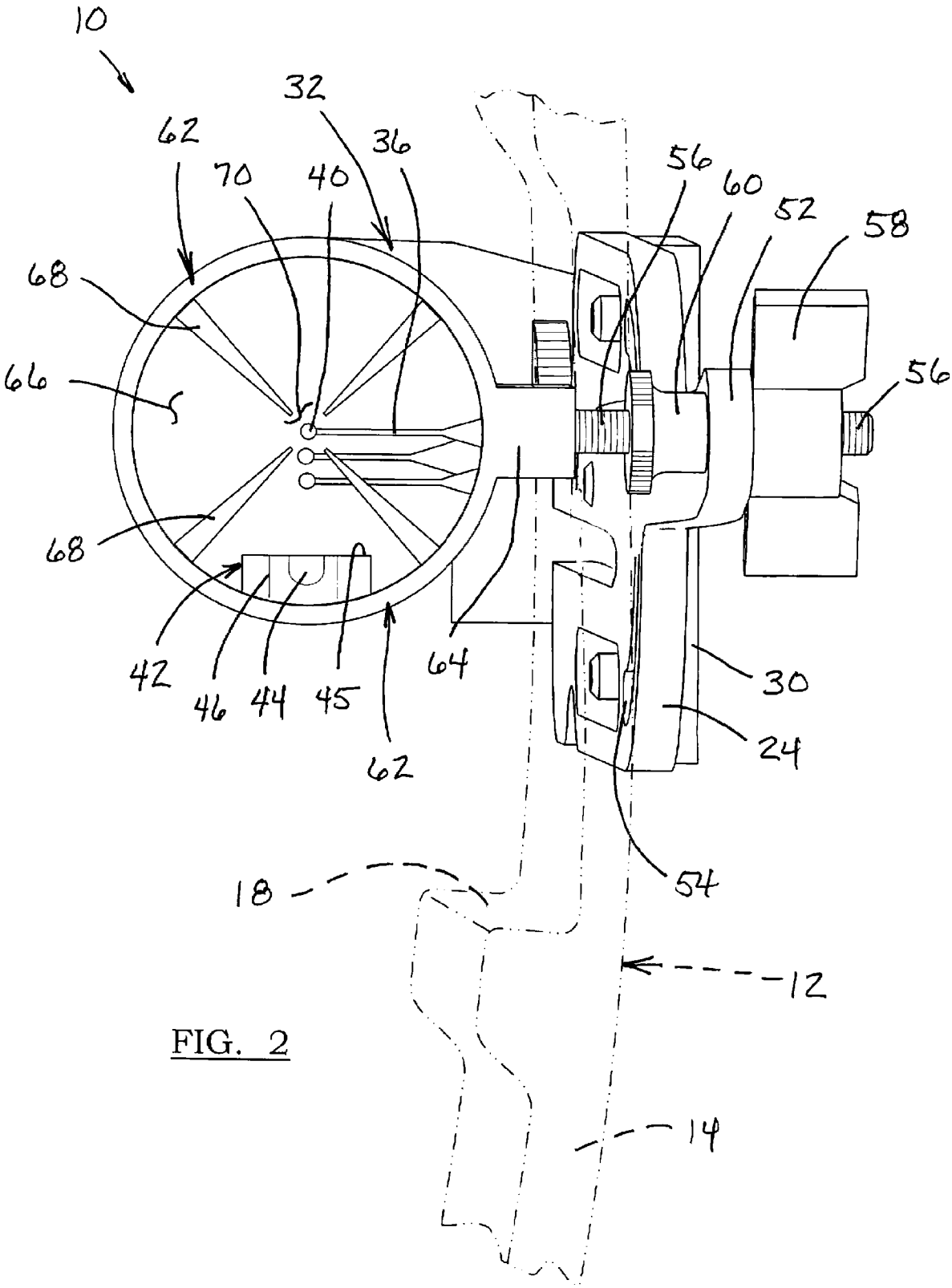
FIG. 2 is a rear elevational view of the sighting system of FIG. 1 when the archery bow is in alignment toward a target.

FIG. 2 generally illustrates the proper orientation of the rear sight 22 relative to the front sight 20 of an archery bow 12 properly aimed with the sighting system 10 embodying the principles of the present invention. As illustrated, the bow 12 is aimed with no or neutral torque, and the luminous ring 50 is obscured from the view of the archer by the rear sight ring 62.

Figure 3:
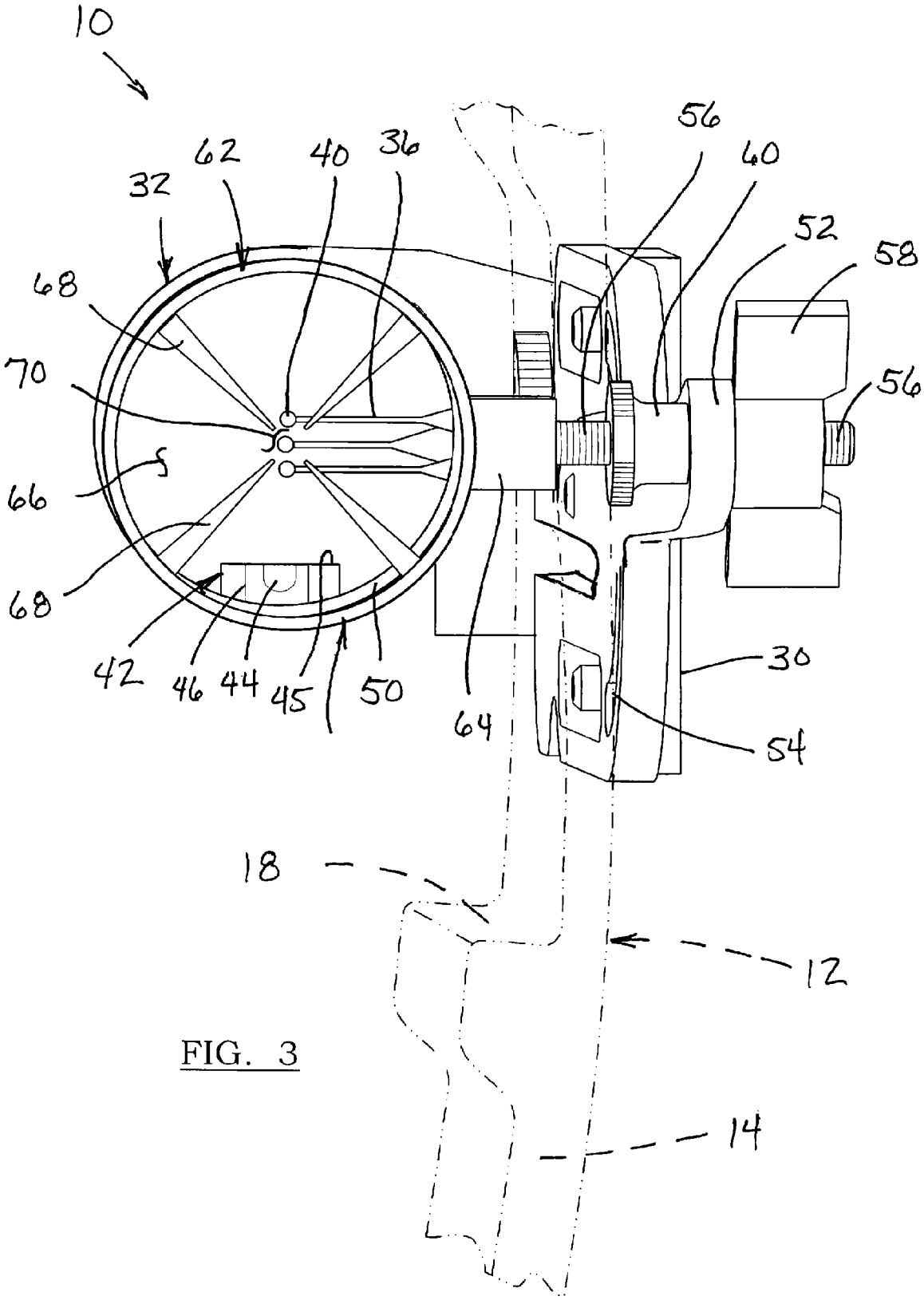
FIG. 3 is a rear elevational view of the sighting system of FIG. 1 when the archery bow is out of alignment, in particular showing left bow torque.

If the bow 12 is subjected to torque by the archer, then the ring 62 of the rear sight 22 will be misaligned with the ring 32 of the front sight 20 and will not completely obstruct the luminous ring 50 of the front sight 20. As seen in FIG. 3, when the bow 12 is subjected to torque, portions of the luminous ring 50 and front sight ring 32 become visible to the archer. In the drawing of FIG. 3, the bow 12 is shown as being subjected to left torque and a portion of the luminous ring 50, as well as a portion of the frame 32, is visible to the right interior and left exterior of the rear sight window 66 and ring 62, respectively.

In the illustrated embodiment, the luminous ring 50 is provided with a radial dimension that is less than the full radial thickness of the front sight ring 32 about the sight window 34. This is readily seen in FIG. 1. Alternatively, the radial width of the of the luminous ring 50 may be equal to the radial thickness of the front sight ring 32 and can extend on the rear face 48 from the edge of the rear sight window 34 to the outer edge of the front sight ring 32.

Torque is not typically an issued when shooting a firearm. However, when applied to a firearm, the dual rings of the present invention provide positive feedback to ensure that the shooter's eye is located in the proper position relative to the scope.

Scopes are designed to be used with the eye of the shooter at a proper relief distance. If the shooter's eye is too close, too far away, to the left, to the right, too high or too low, it can affect the outcome of the shot or result in injury to the shooter. (If the shooter's eye is positioned too close to the scope, kick from the firearm during firing can cause the scope to move rearward and strike the forehead of the shooter.)

The most rearward portion of the scope defines a ring within which the rear lens of the scope is recessed, thereby forming a protective hood about the rear lens. With the present invention, this rear portion of the scope defines the front ring of the sighting system and would include a luminous ring. With the present invention, a rear ring (which could be an integral part of the scope or separately mounted to the firearm) is located a distance rearward of the rear portion of the scope. When aiming the firearm, this rear ring would aid in the correct eye relief and coordinate the shooter's eye with the center of the scope (proper eye relief) when taking aim. As with the archery bow embodiment, if the shooter's eye was improperly aligned with the scope, the luminous ring on the rear portion of the scope would be visible to the shooter. If the shooter's eye was properly aligned with the scope, the luminous ring on the rear portion of the scope would not be visible to the shooter. Rather, the rear ring would obstruct the luminous ring on the rear portion of the scope.

As a person skilled in the art will readily appreciate, the above description is meant as an illustration of implementation of the principles this invention. This description is not intended to limit the scope or application of this invention in that the invention is susceptible to modification, variation and change, without departing from spirit of this invention, as defined in the following claims.

I claim:

1. A sighting system for aiming a shooting device having a forward and rearward ends, the system comprising:

a first sight to be supported by the shooting device toward the forward end thereof, the first sight including a first sight frame having portions defining a first sight window therein, the first sight frame also including a rear face oriented in a direction toward the rearward end of the shooting device, at least a portion of the rear face including an indicium thereon, the indicium being visibly different from other portions of the rear face; and a second sight supported by the shooting device generally toward the rearward end thereof, the second sight including a second sight frame having portions defining a second sight window therein, the second sight frame having dimensions such that the indicium on the rear face is at least partially obstructed in a first manner by the rear sight frame when the shooting device is properly aimed at a target and is at least partially obstructed in a second manner when the shooting device is improperly aimed.

2. The sighting system of claim 1 wherein the indicium is luminous.

3. The sighting system of claim 1 wherein the indicium is formed of a luminescent material.

4. The sighting system of claim 1 wherein the indicium is formed of one of a photoluminescent material and a fluorescent material.

5. The sighting system of claim 1 wherein the indicium is formed in an annular shape.

6. The sighting system of claim 1 wherein the indicium completely circumscribes the front sight window.

7. The sighting system of claim 1 wherein the indicium is formed of a fiber optic material.

8. The sighting system of claim 1 wherein the first sight frame and the second sight frame are of the same general shape.

9. The sighting system of claim 1 wherein the first sight frame and the second sight frame have one of an exterior dimension and an interior dimension of substantially the same size.

10. The sighting system of claim 1 wherein the first sight frame and the second sight frame are annular in shape.

11. The sighting system of claim 1 wherein the indicium and the second sight frame are of generally the same shape.

12. The sighting system of claim 1 wherein the indicium and the second sight frame are generally annular in shape.

13. The sighting system of claim 1 further comprising at least one first sighting element extending generally toward a center area of the first sight window, the at least one first sighting element being viewable through the second sight window during aiming of the shooting device.

14. The sighting system of claim 13 wherein the at least one first sighting element is a fiber optic sight pin.

15. The sighting system of claim 1 further comprising at least one second sighting element extending generally toward a center area of the second sight window.

16. The sighting system of claim 15 wherein the at least one second sighting element defines an open area generally in the center area of the rear sight window.

17. An archery bow and sighting system comprising:

an archery bow having a riser defining forward and rearward sides thereof, a pair of limbs extending from the riser, and a bow string generally extending between the limbs;

a front sight mounted to riser and located toward the forward side thereof, the front sight including a front sight frame having portions defining a front sight window therein, the front sight frame also including a rear face oriented in a direction toward the rearward side of the riser, the rear face including a luminous indicium thereon that at least partially circumscribes the rear face; and a rear sight mounted to the riser and located toward the rearward side thereof, the rear sight including a rear sight frame having portions defining a rear sight window therein, the rear sight frame having dimensions such that the luminous indicium on the rear face is at least partially obstructed in a first manner by the rear sight frame when the bow is properly aimed at a target and is at least partially obstructed in a second manner when the bow is improperly aimed at a target, the first and second manners being identifiably different.

18. The archery bow and sighting system of claim 17 further comprising at least one front sighting element extending generally toward a center area of the front sight window, the at least one front sighting element being viewable through the rear sight window during aiming of the bow.

19. The archery bow and sighting system of claim 18 wherein the luminous indicium is formed of one of phosphorescent material, a florescent material, a fiber optic material and a powered light source.

20. A method of aiming a shooting device comprising the steps of:

providing a sighting system having a front sight, the front sight including having front sight frame with a rearwardly oriented rear face, the rear face including indicium formed thereon, the sighting system also having a rear sight including a rear sight frame;

aiming the shooting device at a target; and positioning the shooting device such that the rear sight frame at least partially obstructs the indicium in a first manner when the shooting device is properly aimed and at least partially obstructs the indicium in a second manner when the shooting device is improperly aimed, the first and second manners being identifiably different.

* * * * *